US008211266B2

(12) United States Patent
Yoneyama

(10) Patent No.: US 8,211,266 B2
(45) Date of Patent: Jul. 3, 2012

(54) BADMINTON RACKET AND MANUFACTURING METHOD OF BADMINTON RACKET

(75) Inventor: Minoru Yoneyama, Tokyo (JP)

(73) Assignee: Yonex Kabushiki Kaisha, Tokyo (JP)

( * ) Notice: Subject to any disclaimer, the term of this patent is extended or adjusted under 35 U.S.C. 154(b) by 204 days.

(21) Appl. No.: 12/671,449

(22) PCT Filed: Jul. 29, 2008

(86) PCT No.: PCT/JP2008/063570

§ 371 (c)(1),
(2), (4) Date: Mar. 3, 2010

(87) PCT Pub. No.: WO2009/017112

PCT Pub. Date: Feb. 5, 2009

(65) Prior Publication Data

US 2010/0212805 A1 Aug. 26, 2010

(30) Foreign Application Priority Data

Aug. 1, 2007 (JP) ..... 2007-201172

(51) Int. Cl.
*B32B 37/00* (2006.01)

(52) U.S. Cl. ..... 156/293; 156/304.1; 156/242; 156/245

(58) Field of Classification Search ..... 156/304.1, 156/60, 242, 245, 293, 294
See application file for complete search history.

(56) References Cited

U.S. PATENT DOCUMENTS 4,575,084 A * 3/1986 Yoneyama ..... 473/535
6,896,320 B2 * 5/2005 Kropfeld ..... 296/203.01

FOREIGN PATENT DOCUMENTS

| | | | |
|---|---|---|---|
| CN | 1062093 | A | 6/1992 |
| CN | 1488415 | A | 4/2004 |
| EP | 1388354 | A1 | 2/2004 |
| EP | 1388354 | B1 | 5/2005 |
| JP | 61-14064 | U | 1/1986 |
| JP | 08299513 | A | 11/1996 |
| JP | 200465862 | A | 3/2004 |

OTHER PUBLICATIONS

Derwent Abstract of Chinese Patent 1483495, patented Mar. 24, 2004.*
Chinese Patent Application No. 200880110476.3: First Office Action, dated Jul. 25, 2011.

* cited by examiner

*Primary Examiner* — Jeff Aftergut
(74) *Attorney, Agent, or Firm* — McDermott Will & Emery LLP; Louis J. DelJuidice, Esq.

(57) ABSTRACT

A badminton racket that is strong in respect to impact and twist and that is high in surface stability and a manufacturing method of the badminton racket is provided. A badminton racket includes a frame formed circularly, a shaft joined to the frame, a joint installed reaching inside the frame and the shaft at a joint portion of the frame and the shaft, and an expandable resin placed between the joint and the frame. A badminton racket manufacturing method includes an expandable resin placing process that places an expandable resin that expands when heated on an outer periphery of a portion of a joint, the joint being to be installed to reach inside a frame formed with the resin sheet tube and inside a shaft, the portion being to be installed in the frame.

3 Claims, 2 Drawing Sheets

BADMINTON RACKET AND MANUFACTURING METHOD OF BADMINTON RACKET

CROSS-REFERENCE TO PRIOR APPLICATION

This is the U.S. National Phase Application under 35 U.S.C. §371 of International Patent Application No. PCT/JP2008/063570 filed Jul. 29, 2008, which claims the benefit of Japanese Patent Application No. 2007-201172 filed Aug. 1, 2007, both of which are entirely incorporated by reference herein. The International Application was published in Japanese on Feb. 5, 2009 as WO2009/017112 A1 under PCT Article 21(2).

TECHNICAL FIELD

The present invention relates to a badminton racket provided with a joint reaching inside a frame and inside a shaft and a manufacturing method of a badminton racket thereof.

BACKGROUND ART

In prior art, as a badminton racket, there is known a badminton racket with a hollow frame formed in an oval shape and a hollow shaft that are joined provided with a T-shaped joint reaching inside the frame and inside the shaft. In such a badminton racket, firstly, a hollow member for forming the frame is bent circularly, and the joint with liquid adhesive is inserted to reach between both end portions and one end portion of the shaft. Then, a fiber reinforced plastic resin tape is wound on an outer periphery of a joining portion of the frame and the shaft for reinforcement, and then put in a die and heated and formed (refer to for example, Japanese Patent No. 2004-65862). Therefore, it is preferable that an inner diameter of the frame is formed sufficiently larger that an outer diameter of the joint so that the joint can be easily inserted into the hollow frame.

DISCLOSURE OF INVENTION

Problems to be Solved by the Invention

However, when an inner diameter of the frame is formed sufficiently larger than an outer diameter of the joint, there is a possibility that a gap is formed in between an inner peripheral surface of the frame and an outer peripheral surface of the joint at the time the frame and the shaft are joined. There was a problem that a joining portion of a frame and a shaft with a gap formed inside is weak with respect to impact and twist when hitting a shuttle and low in surface stability, therefore the flight direction of the shuttle that was hit could not be easily decided.

The present invention was made in view of the above described problem, and its object is to provide a badminton racket that is strong in respect to impact and twist and high in surface stability and a manufacturing method of such a badminton racket.

Means for Solving the Problems

In order to achieve the above described object, a badminton racket according to the invention is characterized by including:

a frame formed circularly;

a shaft joined to the frame;

a joint installed reaching inside the frame and the shaft at a joint portion of the frame and the shaft; and an expandable resin placed between the joint and the frame.

According to a badminton racket of the present invention, since an expandable resin is placed in between the joint, that is installed reaching inside the frame and the shaft, and the frame, a gap between the joint and the frame is not formed easily, and it is possible to realize a badminton racket with high surface stability. Since the expandable resin that is placed in between the joint and the frame is expanded expandable resin, by providing the expandable resin in a state before it is expanded in between the joint and the frame, and then expanding it, the expandable resin can be made to sufficiently reach all over the gap between the joint and the frame. Therefore it is possible to realize a badminton racket that is stronger in respect to impact and twist and that is high in surface stability, and to improve the direction and speed of the shuttle that was hit.

In such a badminton racket, it is preferable that the joint is made of a resin.

According to such a badminton racket, since the joint installed reaching inside the frame and the shaft is made of a resin, it is possible to make the racket lighter than, for example, in the case where a metallic joint is used.

Further, a badminton racket manufacturing method includes:

a resin sheet tube faulting process that forms a resin sheet tube by placing an expandable resin that expands when heated on an inner side of a thermoplastic resin sheet and rolling the thermoplastic resin sheet into a cylindrical shape;

an expandable resin placing process that places an expandable resin that expands when heated to an outer periphery of a portion of a joint, the joint being to be installed to reach
- inside the frame formed with the resin sheet tube and inside a shaft, the portion being to be installed in the frame; and a joining process that joins the frame and the shaft by installing the joint placed with the expandable resin inside
- both end portions of the resin sheet tube, bent circularly and butted against each other, and
- the shaft, and setting the frame, the shaft and the joint in a die, and then heating the frame, the shaft and the joint.

According to such a badminton racket manufacturing method, since the expandable resin placed inside the resin sheet tube and the expandable resin placed on an outer periphery of the joint and installed inside the frame are both expanded by heat, by installing the joint inside the both end portions of the resin sheet tube bent circularly and butted against each other and inside the shaft, and setting them in the die and heating them, it is possible to expand the expandable resin inside the frame including the joining portion with the shaft and to fill the inside of the frame. A peripheral portion of the resin sheet tube that forms the frame is formed of a thermoplastic resin sheet, so that the peripheral portion of the resin sheet tube deforms by heating the die. Thus, by the expandable resin placed inside the resin sheet tube and on the outer periphery of the joint expanding, the resin sheet tube is spread out along the die, and it is possible to form the frame in a desired shape along the die. The expandable resin expands in the joining portion of the frame and the shaft, so that it is possible for the overall frame to be formed in a desired shape along the die and also to join the frame and the shaft without forming a gap between the frame and the joint. Thus, just by setting the resin sheet tube, the shaft, and the joint placed with the expandable resin on the outer periphery in the die and heating it, it is possible to easily manufacture a badminton racket with a higher surface stability.

Regarding the badminton racket manufacturing method, it is preferable that the expandable resin has a resin and a foaming agent that expands when heated.

According to such a badminton racket, since the expandable resin has a foaming agent that expands by heating, it is possible to more surely make the resin expand by heating, and further by the foaming agent expanding it is possible to easily make the resin reach all over in between the frame and the joint without a gap. Therefore, by placing the expandable resin that is in a non expanded state in between the joint and the frame and then heating it, it is possible to easily fill the gap between the joint and the frame with the expandable resin by expanding the foaming agent.

EFFECT OF THE INVENTION

According to the present invention, it is possible to provide a badminton racket that is strong in respect to impact and twist and that is high in surface stability and a manufacturing method of the badminton racket thereof.

Features and objects of the present invention other than ones stated above will be apparent from the following detailed description with reference to the drawings attached herein.

LIST OF REFERENCE NUMERALS

1 frame, 2 shaft, 3 grip, 4 joint,
to-be-frame installed portion 4*a*,
to-be-shaft installed portion 4*b*,
5 expandable resin, 5*a* expandable resin,
6 expandable resin, 6*a* expandable resin,
7 reinforcing portion, 10 badminton racket

BEST MODE FOR CARRYING OUT THE INVENTION

The preferred embodiment of the present invention will be described hereunder with reference to the appended drawings.

Figure 1:
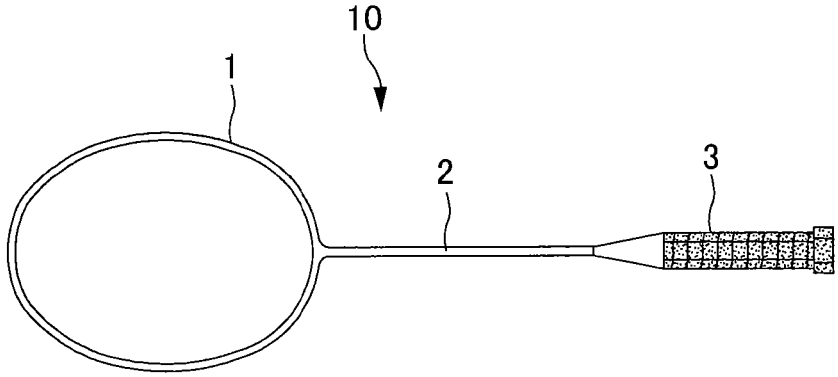
FIG. 1 is an external view of a badminton racket according to the present invention.

FIG. 1 shows a front view of a badminton racket according to the present invention. As shown in FIG. 1, the badminton racket 10 includes a frame 1 formed circularly when seen externally, a shaft 2 that is joined to the frame 1 at one end, and a grip 3 provided at another end portion side of the shaft 2.

Figure 2:
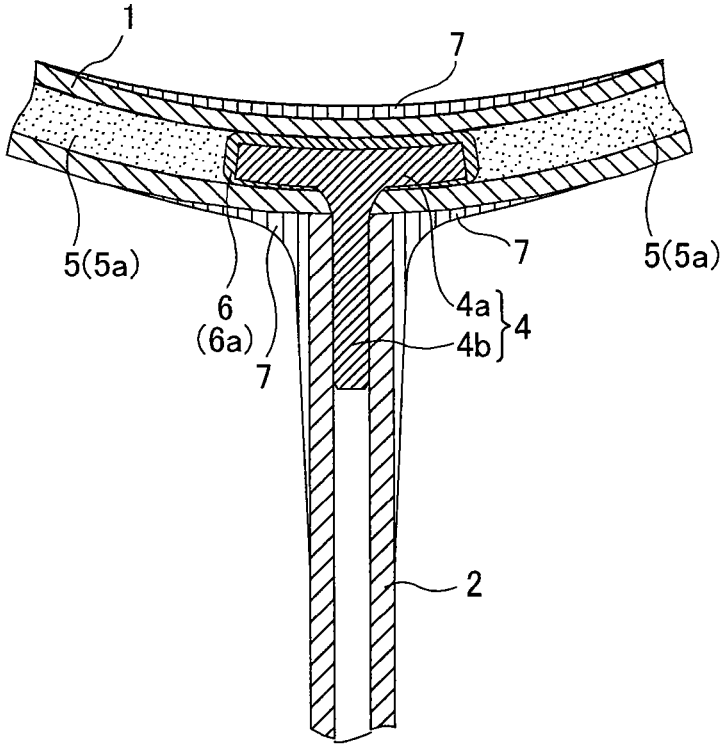
FIG. 2 is a partial sectional view showing a joining portion of the frame and the shaft of the badminton racket according to the present invention.

FIG. 2 is a sectional view showing a joining portion of the frame and the shaft. As shown in FIG. 2, the joining portion of the frame 1 and the shaft 2 is installed with a joint 4 that reaches inside the frame 1 and inside the shaft 2, and is reinforced with a reinforcing section 7 that covers a boundary section of the frame and the shaft from the outside The frame 1 is a hollow body made of a fiber reinforced plastic mainly composed of carbon fiber and has an expandable resin 5 inside. Further, the shaft 2 is also a hollow body made of the fiber reinforced plastic with mainly carbon fiber, but it is hollow inside. The joint 4 is made of a metallic member such as for example, an aluminum alloy.

The joint 4 includes a to-be-frame installed portion 4*a* that is installed in the circular frame 1 and is slightly curved, and a to-be-shaft installed portion 4*b* that is provided approximately vertically to the to-be-frame installed portion 4*a* from approximately the center in the longitudinal direction of the to-be-frame installed portion 4*a* in an approximately T-shape. A sectional shape of the to-be-frame installed portion 4*a* is an oval shape that is long and flat in the front and back surface of a hitting surface of the badminton racket 10, similar to the sectional shape of the frame 1. A sectional shape of the to-be-shaft installed portion 4*b* is the same shape as the sectional shape of the shaft 2.

An outer diameter of the to-be-frame installed portion 4*a* is formed smaller than an inner diameter of the frame 1 and an outer diameter of the to-be-shaft installed portion 4*b* is formed smaller than an inner diameter of the shaft 2.

The expandable resin 6 is placed in between the inside of the frame 1 and the to-be-frame installed portion 4*a*, and the expandable resin 6 fills in between an inner peripheral surface of the frame 1 and the outer peripheral surface of the to-be-frame installed portion 4*a*.

The expandable resin 6 is an expandable resin that has mixed together an epoxy resin elastic adhesive, that is made of mainly an epoxy resin intermediate and a deformed resin family polyamine that is a curing agent, and nitrile thermal expansion microcapsules that are foaming agents, and the resin is in an expanded state. The expandable resin is mixed with approximately 10% to 15% of the nitrile thermal expansion microcapsules.

According to the badminton racket 10 in this embodiment, the expandable resin 6 is placed in between the joint 4, that is installed reaching inside both the frame 1 and the shaft 2, and the frame 1, so that a gap is not formed easily in between the frame 1 and the joint 4, and it is possible to realize the badminton racket 10 with a high surface stability. In particular, since the resin placed in between the frame 1 and the joint 4 is expandable resin, it is possible to make the expandable resin 6 sufficiently spread all over the gap between the frame 1 and the joint 4 by placing the expandable resin that is in an unexpanded state in between the frame 1 and the joint 4 and then expanding it. Therefore, it is possible to realize the badminton racket 10 that is strong in respect to impact and twisting and that has high surface stability, and to improve the direction and speed of the shuttle that is hit.

Figure 3:
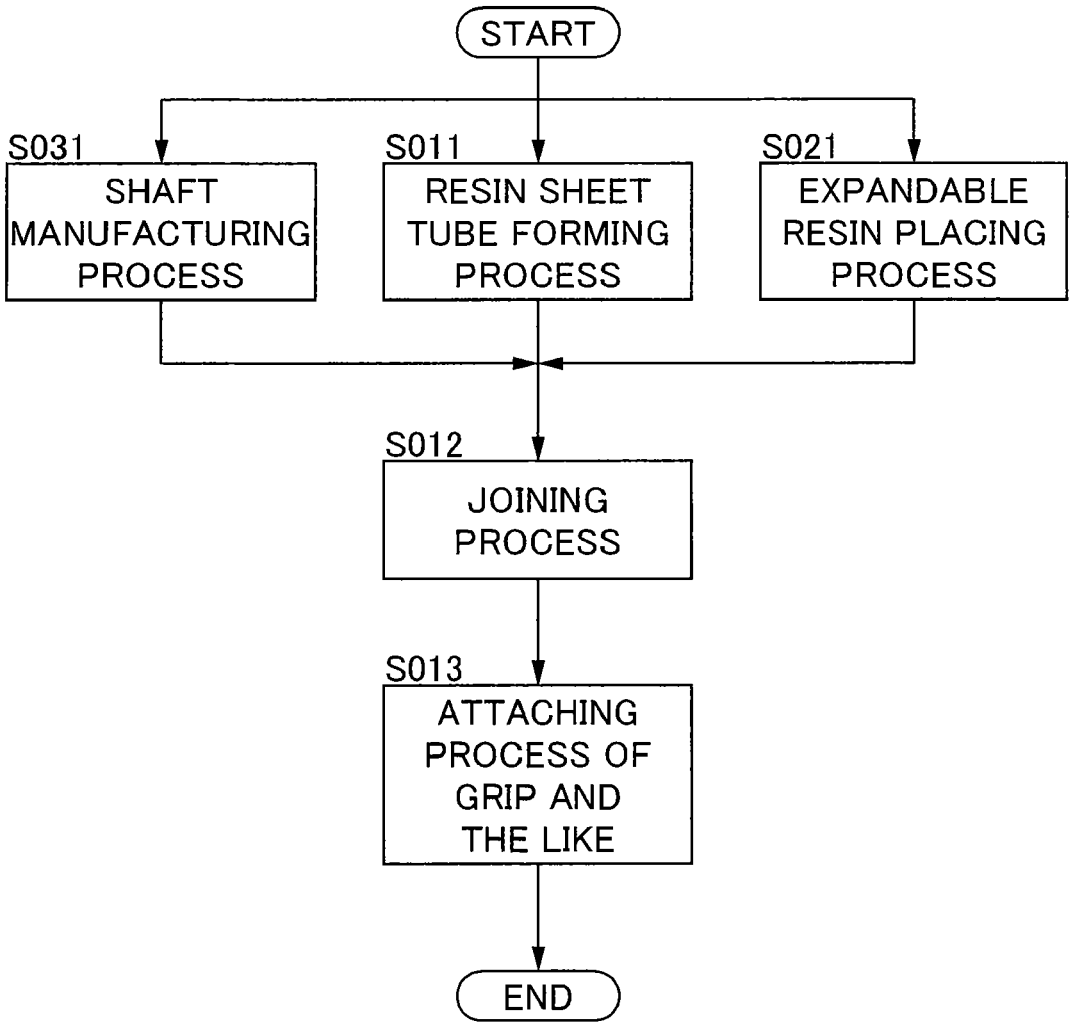
FIG. 3 is a view explaining a manufacturing method of the badminton racket according to the present invention.

FIG. 3 is a diagram showing a manufacturing method of a badminton racket.

As shown in FIG. 3, first, carbon pre-pregs are layered concentrically as a plurality of thermoplastic resin sheets, and heated, and a hollow body to be the shaft 2 of the badminton racket 10 is manufactured in advance (shaft manufacturing process: S031).

Further, the T-shaped joint 4 made of aluminum alloy is placed with an expandable resin 6*a* that expands when heated on an outer periphery of the to-be-frame installed portion 4*a* (expandable resin placing process: S021). The expandable resin 6*a* which expands when heated may be coated by soaking the to-be-frame installed portion 4*a* of the joint 4 in a liquid thermally foamable resin and drying it, or a thermally foamable resin that is formed in a sheet shape of approximately 0.3 mm thick may be wrapped in advance excluding a portion that connects the to-be-frame installed portion 4*a* and the to-be-shaft installed portion 4*b*.

Next, a plurality of carbon pre-pregs as thermoplastic resin sheets are layered, and on its inner side the expandable resin

5*a*, that expands when heated, is placed to form a resin sheet tube wrapped cylindrically (resin sheet tube forming process: S011). Here, the expandable resin 5*a* that is placed on the inner side of the carbon pre-preg is stopped sufficiently inside from an end of the resin sheet tube so that the expandable resin 5 does not project out from the end of the resin sheet tube at the time the expandable resin 5*a* is expanded.

Then, after installing the joint 4 that is placed with the expandable resin 6*a* reaching inside both end portions, that are butted by bending the resin sheet tube circularly, and the shaft 2 manufactured in advance, and setting them in a die, they are heated and the frame 1 and the shaft 2 are joined (joining process: S012). A portion in which the expandable resin 5*a* is not placed at both end portions of the resin sheet tube bent circularly and butted is installed with the to-be-frame installed portion 4*a* of the joint 4 placed with the expandable resin 6*a*, the to-be-shaft installed portion 4*b* is inserted into the shaft 2, and a front end of the shaft 2 is abutted against the to-be-frame installed portion 4*a*. Further, before the joint that is installed inside the frame 1 and the shaft 2 is placed in the die, a band-shaped carbon pre-preg is wrapped over both end portions of the resin sheet tube at the joining portion of the frame 1 and the shaft 2. The portion at which the band-shaped carbon pre-preg is wrapped becomes a reinforced portion 7 in the joining portion of the frame 1 and the shaft 2.

In the joining process (S012), the layered carbon pre-preg sheets of the resin sheet tube that forms the frame 1 are heated and deform, and at that time, the expandable resins 5*a*, 6*a* placed inside expand and spread out outwardly the layered carbon pre-preg sheets of the resin sheet tube and pushes the outer peripheral surface of the carbon pre-preg sheets against the die. Therefore, the deformed resin sheet tube is formed into a smooth shape along the die without any projections and depressions on the surface. Further, at both end portions of the resin sheet tube butted against each other, that is, the joining portion of the frame 1 and the shaft 2, the expandable resin 6*a* placed in the to-be-frame installed portion 4*a* of the joint 4 expands and spreads out outwardly the carbon pre-preg sheets at the end portion of the resin sheet tube and pushes the outer peripheral surface against the die. Therefore, the joining portion of the frame 1 and the shaft 2 is also formed into a smooth shape with out any depressions and projections on the surface similar to other portions of the frame 1. Further, at the joining portion of the frame 1 and the shaft 2, the expandable resin 6*a* placed in the to-be-frame installed portion 4*a* of the joint 4 expands, fills the gap between the inner surface of the frame 1 and the joint 4 and hardens, and integrates with the shaft 2.

Thereafter, holes for stringing the frame 1 are formed and coated, and the grip 3 is attached to complete the badminton racket 10 (attaching process of the grip and the like: S013).

According to a manufacturing method of the badminton racket 10 of this embodiment, the expandable resin 5*a* placed inside the resin sheet tube and the expandable resin 6*a* placed on an outer periphery of the joint 4 and installed inside the frame 1 both expand by heat. Therefore, by installing the joint 4 inside the both end portions of the resin sheet tube bent circularly and butted against each other and inside the shaft 2, and setting the frame, the shaft and the joint in the die and heating them, it is possible to expand the expandable resins 5*a*, 6*a* inside the frame 1 including the joining portion with the shaft 2. Here, the outer peripheral portion of the resin sheet tube that forms the frame 1 is formed of a thermoplastic resin sheet, so that the outer peripheral portion of the resin sheet tube deforms when the die is heated. Thus, by the expandable resins 5*a*, 6 placed inside the resin sheet tube and on the outer periphery of the joint 4 expanding, the resin sheet tube is spread out along the die, and the frame 1 can be formed into a desired shape. In particular, since the expandable resin 6*a* expands in the joining portion of the frame 1 and the shaft 2, it is possible to form the overall frame 1 along the die into a desired shape, and to join the frame 1 and the shaft 2 without forming any gap between the frame 1 and the joint 4. Thus, it is possible to easily manufacture a badminton racket 10 with higher surface stability merely by setting the resin sheet tube, the shaft 2, and the joint 4 placed with the expandable resin 6*a* on the outer periphery and heating them.

Further, since the expandable resin 6 placed in between the frame 1 and the joint 4 has a foaming agent that expands when heated, it is possible to make the resin easily spread out between the frame 1 and the joint 4 with the foaming agent that has expanded when heated. Thus, by placing the expandable resin 6*a* in an unexpanded state between the joint 4 and the frame 1 and heating them, it is possible to easily fill the gap between the joint 4 and the frame 1 by expanding the foaming agent. Thus, it is possible to realize a badminton racket 10 that is outstanding in manufacturability.

Further, by heating the forming agent expands and the resin inside the expandable resin 6*a* hardens due to a curing agent, so that it is possible to spread out without any gap the expandable resin 6*a* between the frame 1 and the joint 4 and to harden it. Thus, the frame 1 and the joint 4 and the hardened expandable resin 6 integrate, and it becomes possible to provide a badminton racket 10 with higher surface stability.

In the above embodiment, the joint 4 is made of metal, but it may be made of resin or the like. As a joint made of resin, a thermoplastic resin, for example, nylon and the like is applicable. Thus, if the joint is made of a resin, it is possible to make the joint lighter than in the case of using a metallic joint. Further, a resin that is thermoplastic resin mixed with glass fiber is more preferable. With the resin that is thermoplastic resin mixed with glass fiber, it is possible to make the joint lighter and to increase its strength.

Further, in the above embodiment, as an example of the expandable resin, there is given a resin mixed with an epoxy resin elastic adhesive made of an epoxy resin intermediate that is a main component and a deformed resin family polyamine that is a curing agent, and nitrile thermal expanding microcapsules that is a foaming agent, but it is not limited to this.

The above embodiment is described with the badminton racket 10 that is not strung with strings, but a badminton racket 10 strung with strings is also included.

Note that, the above-described embodiment is for a better understanding of the present invention and is not for limiting interpretation of the invention. Various changes and modification can be made without departing from the spirit and scope of the invention, and its equivalents are included within the scope of the present invention.

The invention claimed is:

1. A badminton racket manufacturing method comprising:

a resin sheet tube forming process that forms a resin sheet tube by placing an expandable resin that expands when heated on an inner side of a thermoplastic resin sheet and rolling the thermoplastic resin sheet into a cylindrical shape;

an expandable resin placing process that places an expandable resin that expands when heated on an outer periphery of a portion of a joint, the joint being to be installed to reach inside a frame formed with the resin sheet tube and inside a shaft, the portion being to be installed in the frame; and a joining process that joins the frame and the shaft by installing the joint placed with the expandable resin inside both end portions of the resin sheet tube, bent circularly and butted against each other, and the shaft, and setting the frame, the shaft and the joint in a die, and then heating the frame, the shaft and the joint, and spreading out the both end portions along the die by the expandable resin placed on the joint, wherein in the joining process, a pushing of the resin sheet tube against the die with the expandable resin in the resin sheet tube, and a pushing of the both end portions of the resin sheet tube against the die with the expandable resin on the joint are performed substantially simultaneously.

2. A badminton racket manufacturing method according to claim 1, characterized in that the expandable resin has a resin and a forming agent that expands when heated.

3. A badminton racket manufacturing method according to claim 1, characterized in that:

in the resin sheet tube forming process, the expandable resin is placed on the inner side of the thermoplastic resin sheet such that the expandable resin does not exist inside the both end portions of the resin sheet tube; and in the joining process, the joint placed with the expandable resin is installed inside the both end portions inside which the expandable resin does not exist.

* * * * *